US005400780A

United States Patent [19]

Nishino

[11] Patent Number: 5,400,780

[45] Date of Patent: Mar. 28, 1995

[54] PROTECTIVE MASK AND METHOD OF MANUFACTURE

[75] Inventor: Tetsuya Nishino, 4-4-1-606 Hon-Nakayama, Funabashi-shi, Chiba-ken, Japan

[73] Assignees: Tetsuya Nishino, Chiba; Yoshiyasu Tamoto; Yoshikane Kanemitsu, both of Tokyo, all of Japan

[21] Appl. No.: 109,098

[22] Filed: Aug. 19, 1993

[51] Int. Cl.[6] ..... A62B 7/10

[52] U.S. Cl. ..... 128/205.27; 128/205.28; 128/205.29; 128/206.19

[58] Field of Search ..... 128/205.27, 205.28, 128/205.29, 206.19, 201.25, 205.12; 55/524, 527, 528

[56] References Cited

U.S. PATENT DOCUMENTS

| | | | |
|---|---|---|---|
| 3,800,516 | 4/1974 | Paluch | 128/205.28 |
| 3,884,227 | 5/1975 | Lutz et al. | 128/206.19 |
| 4,084,949 | 4/1978 | Biggins | 55/524 |
| 4,274,914 | 6/1981 | Keith et al. | 55/528 |
| 4,297,117 | 10/1981 | Holter et al. | 128/205.28 |
| 4,382,440 | 5/1983 | Kapp et al. | 128/205.28 |
| 4,643,182 | 2/1987 | Klein | 128/206.19 |
| 5,143,752 | 9/1992 | Nakajima et al. | 128/206.19 |
| 5,269,294 | 12/1993 | Rogozinski | 128/205.28 |

FOREIGN PATENT DOCUMENTS

| | | |
|---|---|---|
| 60-10582 | 4/1985 | Japan . |
| 62-160960 | 10/1987 | Japan . |
| 1-94423 | 6/1989 | Japan . |
| 2-149713 | 12/1990 | Japan . |

*Primary Examiner*—Edgar S. Burr
*Assistant Examiner*—Aaron J. Lewis
*Attorney, Agent, or Firm*—Edward D. C. Bartlett; Ronald B. Sherer

[57] ABSTRACT

A protective mask of simple structure, to be worn easily at the scene of fires, catches and retains poisonous gas contained in smoke generated by fire. The protective mask comprises a pulp fiber structure (1) having a first fiber layer (2) wherein fibers are layered without twining and mixed with gas absorbent pellets (5), which is placed on a second fiber layer (3) having a skin crust (6) formed by hydrating, pressing and drying the surface of one side of the layer of pulp fibers that are not twined. This pulp fiber structure (1) is wrapped in wrapping material (7) and included in a mask body (8) formed with pleats (9) and provided with an aluminum strip piece (11). The first pulp fiber layer (2) is made by causing pulp fibers, obtained by crashing a pulp sheet (30) in a hammer mill, to temporarily stay in a dead air space (C) within the hammer mill; gas absorbent pellets (5), together with air, are supplied by a jet device to the dead air space (C). Both the pulp fibers (4) and gas absorbent pellets (5) fall down and form a layer on tissue paper on a moving belt (38). The second pulp fiber layer (3) is made by causing only pulp fibers to fall on the tissue paper on the moving belt, and then the surface of one side thereof is hydrated, pressed and dried to form the skin crust (6).

13 Claims, 6 Drawing Sheets

FIG. 2(A)
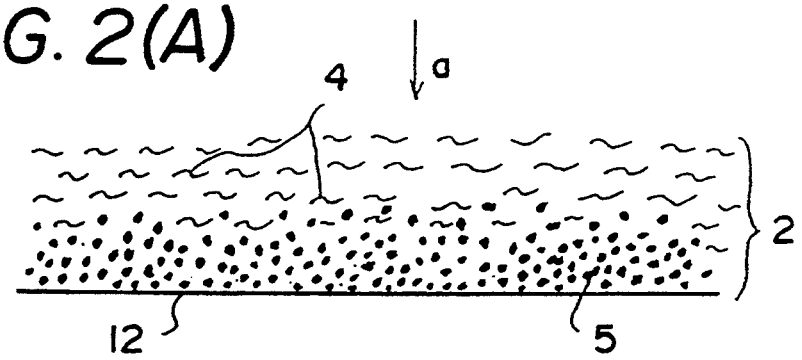
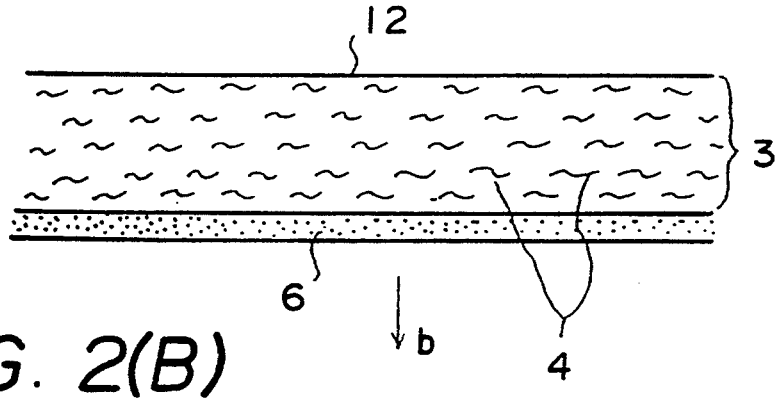
FIG. 2(B)

PROTECTIVE MASK AND METHOD OF MANUFACTURE

BACKGROUND AND SUMMARY OF THE INVENTION

This invention provides a protective mask and a method of manufacture thereof, and more particularly, a protective mask of simple but new structure and a method of manufacturing the new pulp fiber structure which is a vital constituent of the mask. Poisonous gas such as carbon monoxide, which is emanated, for example, when dwelling houses are on fire, is absorbed by said new pulp fiber structure while the gas passes through it. Further according to the present invention, the pulp fiber structure has a first pulp fiber layer having gas absorbents mixed therewith in a preferable manner, and a second pulp fiber layer having a skin crust which is integrally continuous to pulp fibers on the surface of one side, the skin crust being fabricated by hydrating, pressing and drying that surface. After these two layers are superposed, the pulp fiber structure is wrapped to form on an integral structure which is then suitably included in a mask body of preferably non-woven fabric.

In case the of fires in dwelling houses, hotels, inns and other business facilities, there have been reported instances where people died during a period of time before the flames reached the ceiling, because people were unable to move a short distance of three to four meters to get out. In evacuating, a short difference of time and distance may affect human life fatally, and one decisive factor is the poisonous nature of smoke and gas emanated by fire. Smoke caused by fire is, as generally understood, characterized by minute particles of various materials and gas emanated by thermal disintegration and burning and hanging in the air.

Recently, a change in the nature of smoke, due to changes in architectural materials, causes further problems as the smoke at the scene of a fire may now contain carbon monoxide, carbon dioxide, hydrogen cyanide and so forth.

It is also known that when a thick bed quilt of cotton or synthetic fiver burns, a large quantity of carbon monoxide is created. When a person inhales it, the oxygen supplying function of hemoglobin in human blood is hindered, so disturbing the brain and nervous system, causing fatal carbon monoxide poisoning. Further, when silk, wool, nylon carpet or urethane mats burn, hydrogen cyanide gas fumes are given off. When a person inhales even a small quantity of such a gas, they lose consciousness, fall into a fit of convulsions, stop breathing and die. Statistics teach that the mortality rate due to the above described poisonous gas is over 80%.

Numerous protective devices, such as automatic breath protection devices, smoke masks and the like for removing poisonous gas caused by fire, are on the market. However, standards on the safety, adaptability and anti-gas effect established by competent authorities are not clear, so that if the manner of use of such devices is mistaken, there is a danger to human body and life.

There is also provided a gas mask combined with a gas absorbing can for removing poisonous gas. Gas Mask Standard lists five classes and Japanese Industrial Standard lists nine classes depending on the kind of poisonous gas to cope with. Various gas absorbents are filled in nine kinds of such cans. These cans are used in industrial circles, and the users are required to undergo thorough training and expected to have experience so that they may become familiar with the kind of can and absorbent to be used. Such is a system not suitable for use by the ordinary person.

There is a problem if ordinary people always keep such protective devices in stock in anticipation of a fire breaking out in their dwelling house. Even if a person has such a device ready, there is a problem, if the person does not know how to use the device, for them to be able to judge instantly the adaptability or the kind of device when a fire actually breaks out.

Further, there is a risk that the person may lose too much time in trying to wear the device, and so is eventually exposed to death. There may also be a secondary danger resulting from the use of these devices.

The object of the present invention is to solve the above described problems found in the conventional products, and more particularly, to offer a safe and simplified protective mask which may be always stocked in any dwelling house to be worn easily by anybody at a time of fire emergency, in order that the person may evacuate to safety without being exposed to danger caused by the poisonous gas.

The above described problems are solved according to the present invention by offering a protective mask having a first pulp fiber layer in which pulp fibers are lying over or under one another without twining, and gas absorbents are mixed in gaps between the pulp fibers. A second pulp fiber layer, in which pulp fibers are lying over or under one another without twining, has a skin crust, having no gaps between fibers, formed on the surface of one side thereof by a process of hydrating, pressing and drying of fibers. A pulp fiber structure is made up by placing the first pulp fiber layer, with a portion thereof downwards having more gas absorbents than the remaining portion, on a surface of the second pulp fiber layer not having the skin crust.

According to another aspect of the present invention, there is provided a method of manufacturing a protective mask comprising the steps of transforming a pulp sheet to pulp fibers through beating by rotating blades of a hammer mill and causing said pulp fibers, by an air flow formed by said rotating blades, to move and temporarily stay in a dead air space within an apparatus defined by an outer wall, sending to, and causing to stay at, said dead space gas absorbents, together with air, by a jet device, causing said pulp fibers and gas absorbents to fall down and pile on a sheet, preferably a tissue paper, placed on a moving belt to move together therewith to form a first pulp fiber layer.

According to yet another aspect of the present invention, there is provided a method of manufacturing a protective mask comprising the steps of transforming a pulp sheet to pulp fibers through beating by rotating blades of a hammer mill and causing pulp fibers, by an air flow formed by said blades, to move and temporarily stay in a dead air space within an apparatus defined by an outer wall, and causing said pulp fibers to fall down and pile on a tissue paper or like sheet placed on a moving belt to move together therewith. Then hydrating, pressing and drying only one side of a layer of said pulp fibers to form a skin crust integrally continuous to the layer of the pulp fibers.

According to the present invention, a pulp fiber structure is formed by superimposing a first pulp fiber layer, having gas absorbents mixed therewith, on a second pulp fiber layer having a skin crust, the pulp fiber structure is then included in a mask body of non-woven fabric, for example cut out in a mask shape. The mask body preferably has pleats and an aluminum piece. Poisonous ingredients of smoke entering the first pulp fiber layer are absorbed by the gas absorbents, and smoke less the poisonous gas, after having been absorbed the the pulp fibers, finally passes through the skin crust by which remaining poisonous elements are caught and removed.

According to the method of manufacture of the first pulp fiber layer of this invention, a pulp sheet is crashed, i.e. struck, by rotating blades of the hammer mill, transformed into pulp fibers which are caused to move and hang in the air at the dead air space by an air flow formed by the rotation of the blades while gas absorbents are directed to the dead air space by the jet device to be mixed with pulp fibers, then the pulp fibers and gas absorbents fall down and pile on the tissue paper on the moving belt to offer the first pulp fiber layer.

In preparing the second pulp fiber layer, supplying of gas absorbents by the jet device in the above described method is omitted, and the pulp fibers alone are caused to fall down and pile on the tissue paper on the moving belt, then only the upper portion of the pulp fiber layer is hydrated, pressed and dried to form the skin crust. This upper portion becomes an outer, or lower, portion in the assembled protective smoke mask.

Other objects, features and advantages of the present invention will become more fully apparent from the following detailed description of the preferred embodiments, the appended claims and the accompanying drawings.

BRIEF DESCRIPTION OF THE DRAWINGS

In the accompanying drawings:

FIG. 2(A) shows the first pulp fiber layer of the pulp fiber structure of a board shape in cross-section;

FIG. 2(B) shows the second pulp fiber layer in cross-section and makes up the pulp fiber structure with the layer of FIG. 2(A);

DETAILED DESCRIPTION OF THE PREFERRED EMBODIMENTS

Figure 1:
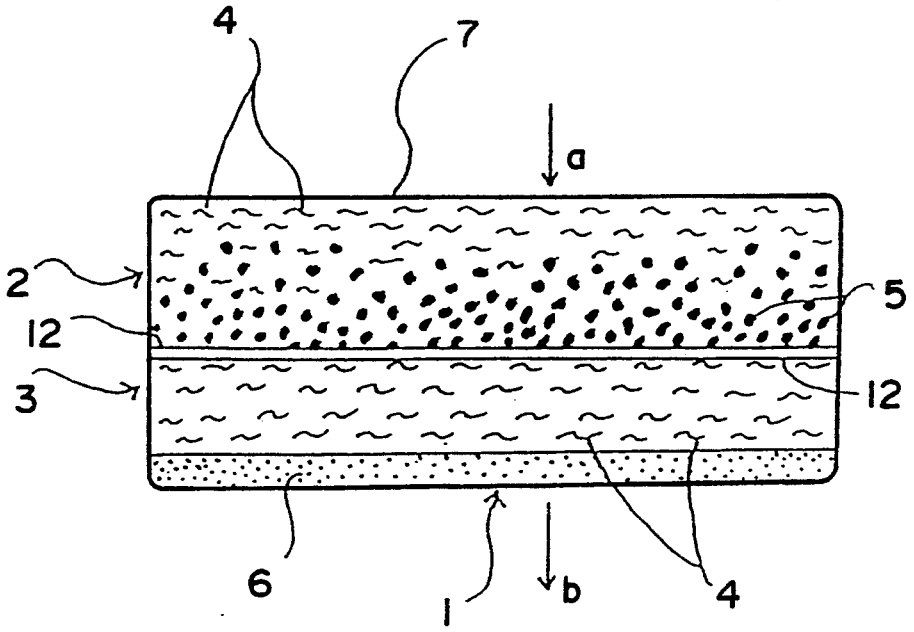
FIG. 1 is a cross-sectional view of the pulp fiber structure of the protective mask of an embodiment of the present invention.

Details of an embodiment of the invention comprising a board shape, pulp fiber structure, having a pulp fiber layer formed with a skin layer and a pulp fiber layer with gas absorbents mixed therein, will first be explained referring to FIGS. 1 to 5. In the drawings, 1 denotes a pulp fiber structure, 2 a first pulp fiber layer, 3 a second pulp fiber layer, 4 pulp fibers, 5 gas absorbents, 6 a skin crust, 9 pleats, 10 ear laces, 11 an aluminum piece, 12 a tissue paper, 13 and 14 the nose and mouth respectively of the mask wearer.

FIG. 2(A) and FIG. 2(B) are, respectively, cross-sectional views of the first pulp fiber layer 2 and the second pulp fiber layer 3 which make up the board shaped, pulp fiber structure 1. Referring to FIG. 2(A), the first pulp fiber layer 2 (to be referred to hereafter as the first layer) has pulp fibers, obtained by beating and crushing a plant pulp sheet, and gas absorbents 5 of pellets supplied by a jet device. The fibers and the gas absorbents mix while the pulp fibers 4 are falling down toward a moving belt. The first layer 2 has pulp fibers which are not twined, so that there are spaces between the fibers. Some portion of the gas absorbents 5 are held between upper ones of the fibers 4, while a substantial portion of the gas absorbents accumulate between lower ones of the fibers 4. In other words, the density of gas absorbents increases downwardly from the top to the bottom as seen in the drawings. The state of the fibers 4 loosely forming a layer is schematically shown by separate short curves in the drawings.

Referring to FIG. 2(B), the second pulp fiber layer 3 (to be referred to hereafter as the second layer), having a skin crust 6, is primarily a layer of short pulp fibers 4 formed by striking and crashing a plant pulp sheet, and the condition of the pulp fibers 4 is the same as that of FIG. 2(A). However, the surface portion of one side of the second layer is hydrated, pressed and then dried to form a skin crust 6 of suitable thickness. In the second layer 3, the skin crust is continuously integral with the layer of non-hydrated pulp fibers forming the body of the second layer 3. As shown in FIG. 2(B), the skin crust 6 is at the bottom of the second layer 3, but in the final structure it is on the outside nearest the face of the user.

According to the present invention, a united pulp fiber structure 1 is formed by putting together the first and second layers, with the lower portion of the first layer 2, where the density of the gas absorbents 5 is greater than that in the remaining upper part, being placed on the side of the second layer 3 opposite to the skin crust 6. Thus, the skin crust is placed on the outside with the portion of greater density gas absorbents on the inside. Referring to the function of catching and taking in of the poisonous gas, outside air containing carbon monoxide, and other elements resulting from fire, enters in the direction of an arrow a and almost simultaneously carbon monoxide and so forth are taken in and removed in the first layer 2 having the gas absorbents mixed therein. Approximately 95% of carbon monoxide and other elements are caught and removed, and minute particles (other than the poisonous gas) which make up the smoke adhere to, or are absorbed by, the pulp fibers 4.

In the present invention, preferably, a chemical named Hopkalite is used as gas absorbent. It is a catalyst that turns CO, in the presence of oxygen and at room temperature, into $CO_2$ and is used for detection of very small volumes of CO in the air or for quantitative analysis or measurement. The following may be obtained on the market:

| name | mesh |
|---|---|
| Hopkalite I | 10/24 |
| Hopkalite II | 10/24 |

Popkalite I consists of 50% $MnO_2$, 30% CuO, 15% $CO_2O_3$, and 5% $Ag_2O$, while Hopkalite II consists of 60% $MnO_2$ and 40% CuO.

Either of these is mixed with water containing Kaolin, formed into pellets, and dried to be used as the gas absorbents in the protective mask of the invention. Hopkalite is sometimes call Hopkalit.

In the experiments carried out by the inventor, a rubber stopper was placed at one end of a tube having an internal diameter of 23 mm, then Hopkalite pellets were put in the tube. Next, one piece of the first pulp layer (thickness: 10 mm) and another piece of the second pulp fiber (thickness: 10 mm) having the skin crust were put together and placed in the tube. A rubber stopper having a Teflon pipe (internal diameter: 4 mm) was placed at the other end of the tube. Carbon monoxide of 2500 ppm (parts per million) concentration was caused to pass through the tube at a rate of 2.5 liter/minute. The result of analysis revealed gas density of 100 ppm. This value far exceeds the removal standard of 35% imposed by the competent authorities mentioned above.

Next, the second layer 3 having the skin crust 6 will be explained in more detail. In the second layer 3, pulp fibers 4 are not twined, that is, pulp fibers are loosely piled leaving gaps between the fibers. The surface of one side of the layer is hydrated and pressed, so that the fibers are twined and united in an adhering manner. The surface is then dried to provide the skin crust 6 which integrally continues to the pile of fibers.

While the first layer 2 mixed with the gas absorbents and the second layer 3 absorb and remove approximately 95% of carbon monoxide contained in the outside air entering in the direction of the arrow "a" components of smoke less the gas adheres to the surfaces of fibers. That is, in the pulp fiber structure 1 of the invention, components or ingredients of the smoke that pass through the first and second layers are absorbed by fibers 4 that pile up loosely leaving gaps between the fibers, then caught completely by the closely knitted skin crust. Air less carbon monoxide and so forth moves in the direction of an arrow b, and enters in the nose and mouth of the mask user.

FIG. 1 is a cross-sectional view of the pulp fiber structure 1 of the protective smoke mask (to be referred to sometimes hereinafter as the mask), showing the integral pulp fiber structure 1 made of the first layer 2 in which gas absorbents 5 shown by black blot like dots are mixed and the second layer 3 having the skin crust shown by small dots formed on one side of the pulp fiber layer wherein fibers are not twined, the skin crust having been formed by pulp fibers that are twined and united together.

Figure 3A:
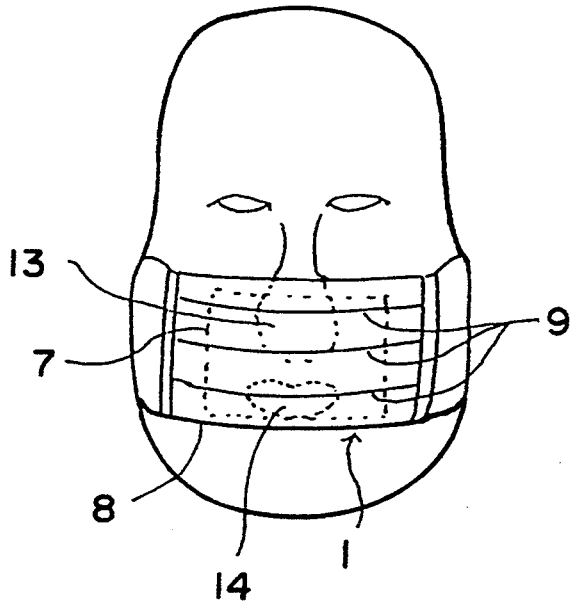
FIGS. 3(A) and 3(B) are respectively front and side views showing the protective mask in use on a user.
Figure 3B:
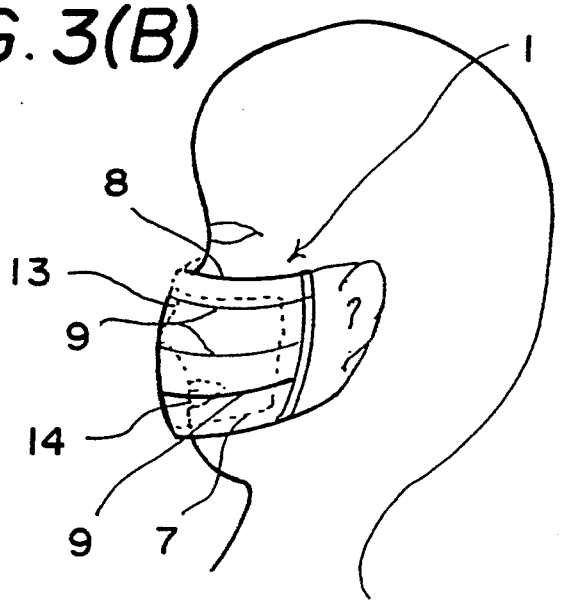
Figure 4:
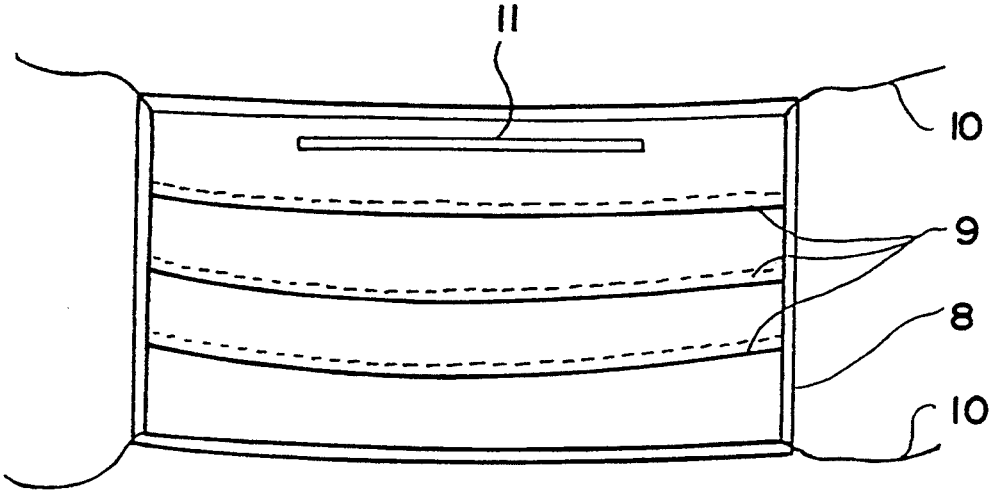
FIG. 4 is a front view of the protective mask to which is attached an aluminum piece.
Figure 5:
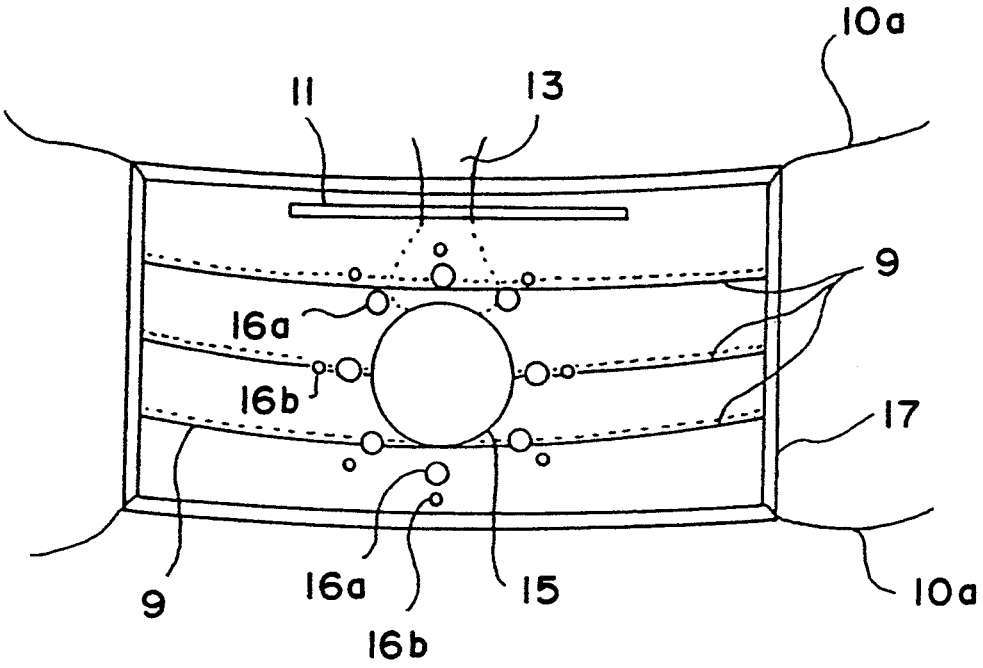
FIG. 5 is a front view of a further embodiment of the invention.

The first and second layers 2, 3 are wrapped by the wrapping material 7 as shown in the drawings, then placed in the mask body 8 of non-woven fabric formed with pleats 9 (as shown in FIGS. 3 to 5). In FIG. 1, outside air comes in the direction of the arrow a, goes out in the direction of the arrow b, then enters the mask user's nose and mouth.

FIG. 2(A) is a cross-sectional view of the first layer 2 which shows gas absorbents 5 of pellets mixed with fibers by means of the jet device while the fibers, crashed and beaten from the plant pulp sheet, are falling down, a substantial portion of the pellets being accumulated between lower fibers. FIG. 2(B) is a cross-sectional view of the second layer 3 showing pulp fibers, not twined and leaving gaps between the fibers, and the skin crust integrally continuous to the fibers; loose pulp fibers absorbing between them minute particles of smoke, and the skin crust completely filtering the air of the remaining minute particles.

FIG. 3(A) and (B) are respectively a front view and a side view of a person wearing the mask. The mask is made up by including the pulp fiber structure 1 in a mask body 8 of non-woven fabric having pleats 9 which are provided for the purpose of allowing extra swelling so that the pulp fiber structure 1 is maintained stably when a person wears the mask.

FIG. 4 is a front view of another embodiment of the invention in which an aluminum piece 11 is attached.

The aluminum piece 11 may be pressed by hand toward the nose when a person wears the mask so that there is no gap between the mask and the nose. Thus, gas around the mask, and particularly gas around the nose may be prevented from entering the nose. The aluminum piece 11 extends lengthwise parallel to the pleats 9 across the face of the user. A further embodiment of the invention is shown in front view in FIG. 5. This embodiment is a mask for those working at the scene of a fire, fireman for example. The mask 17 is made of non-combustible material such as aluminum sheet instead of non-woven fabric, is formed with a hole 15 substantially centrally of the mask and a plurality of holes 16*a*, 16*b* which are smaller than the hole 15. The drawing shows two kinds of holes 16*a* and 16*b*, but if needed, more than two kinds of holes may be provided. While the mask is made of non-combustible material, holes are formed where the mask touches the wearer's nose and mouth so that breathing may not be impeded or interrupted. The drawing shows the mask with an elongate aluminum strip 11, and ear laces 10*a* of non-combustible material. Hole 15 and smaller holes 16*a*, 16*b* may be provided to the mask of FIG. 3 which does not have an aluminum piece.

Now, a method of manufacturing the second layer 2, which is a principal part of the pulp fiber structure 1 of the present invention, will be explained. The main feature of this method is mixing the gas absorbent pellets with pulp fibers using a jet device during the process of causing the fibers to fall down and pile up.

Figure 6:
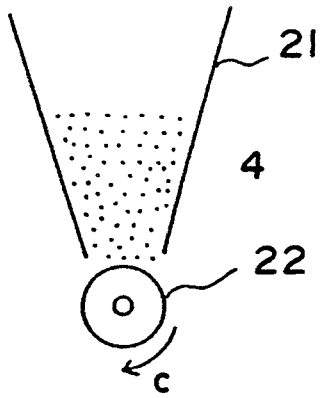
FIG. 6 is a schematic front view of the conventional apparatus for making pulp fiber layer.

According to the conventional method of making pulp fiber layer by the known carding method, pulp fibers obtained by crushing the pulp sheet, are first contained in a box, not shown. Next, pulp fibers 4 are forced into a tapered tube 21, shown in front view in FIG. 6, pressed and hardened. The hardened fibers forced out of the tapered tube 21 are brushed by a brush 22 rotating in the direction of an arrow c and fall down on a moving belt, not shown, under the rotating brush 22, then pile up to make the fiber later. The volume of fibers that pile up depends on the rotating speed of the brush.

In an attempt to mix gas absorbent pellets with pulp fibers utilizing the above described method, the inventor found that a highly complex apparatus appeared to be needed. However, the inventor developed a new apparatus as shown in FIG. 7.

Figure 7:
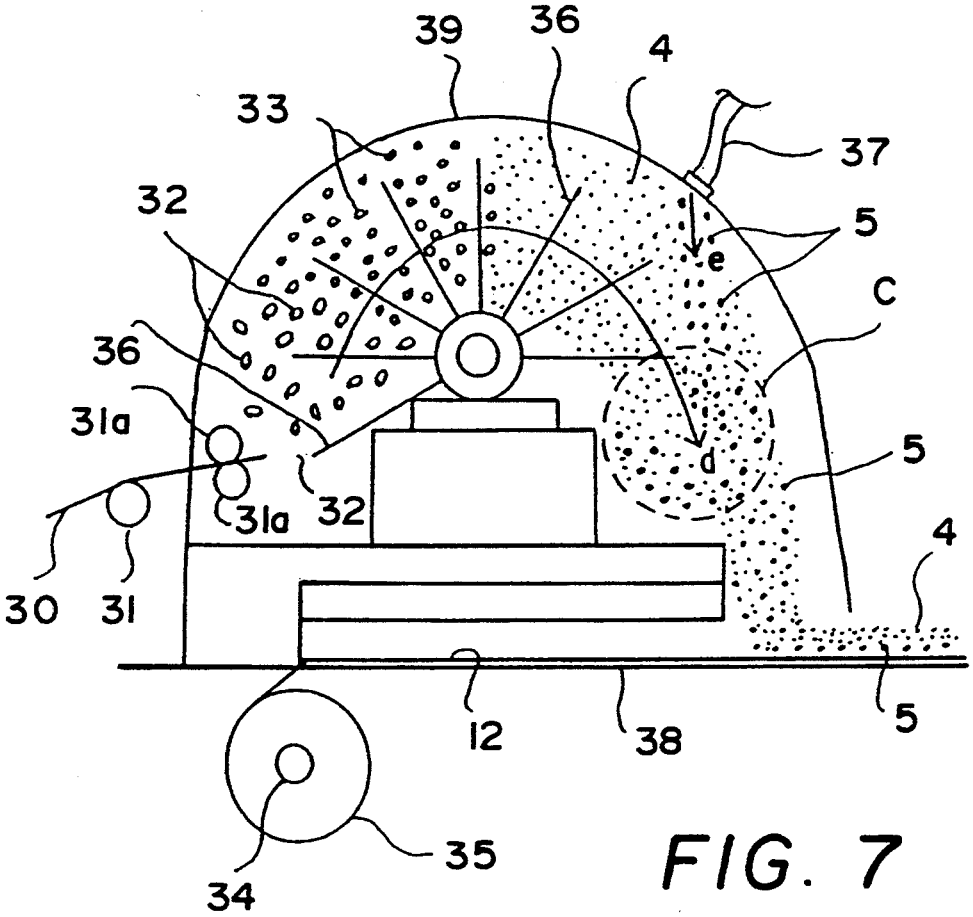
FIG. 7 is a schematic cross-sectional view of an apparatus for making the first pulp fiber layer.

FIG. 7 shows the apparatus for manufacturing the first layer 2 of the pulp fiber structure 1; those components that are the same as ones shown in FIG. 1 to FIG. 6 are denoted by the same reference numerals. 30 denotes a pulp sheet, 31 a roller, 31*a* a pair of rollers, 32 pulp pellets, 33 pulp particles smaller than the pulp pellets, 34 a rotating shaft, 35 a tissue paper roll mounted to the rotating shaft 34, 36 blades of the hammer mill for beating and crashing the pulp, 37 a jet device, 38 a moving belt, and 39 an outer wall of the apparatus, the hammer mill.

The pulp sheet 30, fed into the apparatus from outside is caused to change its direction of movement by the roller 31 and to move between a pair of feed rollers 31*a*. By rotation of the blades 36 of the hammer mill, both shown schematically, the pulp sheet 30 is first transformed into pellets 32, then to pulp particles 33 and finally to pulp fibers 4.

These pulp pellets 32, pulp particles 33 and pulp fibers 4 are moved in a clockwise direction by air flow moving in the direction shown by an arrow d. The rotating shaft 34, rollers 31, 31*a* and moving belt 38 are respectively driven by power sources, not shown.

On the other hand, gas absorbents 5 in the form of pellets are supplied into the apparatus as shown by an arrow e together with air by the jet device 37.

Pulp fibers 4 obtained by crashing as explained above stay in the dead air space C due to air resistance where the fibers mix with the gas absorbent pellets 5 blown out of the jet device 37, then fall down very slowly onto the moving belt 38 on which they pile up. Due to the difference of specific gravities, pulp fiber 4 and the gas absorbent pellets 5 are not mixed evenly. Rather, when the pulp fibers 4 and gas absorbent pellets 5 pile up, in a controlled manner, to form the first layer 2, more of the gas absorbent pellets 5 become positioned in the lower part of the first layer 2 than any other part thereof.

For fabricating the second layer 3, the operation of the jet device explained above is suspended, so that only the pulp fibers 4 are deposit as a layer on the tissue paper 12 on the moving belt 38. Then, using another device, now shown, small particles of water are blown against the upper surface of the pulp fibers 4 on the tissue paper 12 while on the moving belt 38 to moisten the pulp fibers there, pressure is applied from above to the pulp fibers which are then dried to complete the second layer 3 and the integral skin crust thereof.

Next, the second layer 3 is turned upside down, as shown in FIG. 1, that is, it is brought to a state opposed to that when on the moving belt 38, and the first layer 2 is placed, orientated as it was on the moving belts 38, on the second layer 3 to form the pulp fiber structure 1. The superimposed layers 2, 3 of the fiber structure 1 are then enclosed completely by the wrapping material 7, and finally cut to a size which is determined by the size of the mask body 8. Although the length of the wrapped fiber structure may be cut after wrapping, the wrapping may be performed after cutting.

It will be appreciated from the foregoing, that the invention is simple. By placing this protective breathing mask at a conspicuous place in a dwelling house, hotel, inn and so forth, anyone can wear it on their face at the time of a fire emergency and may avoid the danger caused by carbon monoxide and so forth.

The above described embodiments, of course, are not to be construed as limiting the breadth of the present invention. Modifications, and other alternative constructions, will be apparent which are within the spirit and scope of the invention as defined in the appended claims.

What is claimed is:

1. A protective mask, comprising:

a first pulp fiber layer having pulp fibers lying over or under one another without being twined together with gaps between the pulp fibers;

gas absorbents mixed in at least some of said gaps;

said first pulp fiber layer having upper and lower portions with said lower portion having more of said gas absorbents therein than said upper portion;

a second pulp fiber layer having pulp fibers lying over or under one another without being twined together, and a skin crust;

said second pulp fiber layer having an upper side and a lower side, said skin crust being located on said lower side;

said skin crust being formed by a process of hydrating, pressing and drying the pulp fibers at said lower side; and said first pulp fiber layer being superimposed on said second pulp fiber layer with said lower portion of said first pulp fiber layer being placed on said upper side of said second pulp fiber layer to form a pulp fiber structure.

2. The protective mask of claim 1, wherein said pulp fiber structure is enclosed in wrapping material and supported in a mask body.

3. The protective mask of claim 1, wherein said gas absorbents comprise pellets.

4. The protective mask of claim 1, wherein the density of said gas absorbents in said first pulp fiber layer increases downwardly from said upper portion.

5. The protective mask of claim 1, wherein said pulp fiber structure is supported by a mask body, and said mask body is formed with pleats.

6. The protective mask of claim 2, wherein an aluminum piece is secured to said mask body.

7. The protective mask of claim 5, wherein an aluminum strip is secured to said mask body.

8. The protective mask of claim 1, wherein said pulp fiber structure is disposed in a mask body, a central hole being formed substantially at the center of said mask body, and a plurality of further holes smaller than said central hole are formed outwardly of said central hole.

9. A protective breathing mask for use in fires, comprising:

a mask body to cover the nose and mouth of a user;

a first layer of pulp fibers having an upper portion and a lower portion;

a second layer of pulp fibers having an upper side and a lower side;

said first layer being superimposed on said second layer with said lower portion being placed against said upper side;

said superimposed layers being enclosed in wrapping material and supported by said mask body;

the pulp fibers of both said first and second layers being loosely arranged with gaps between the pulp fibers;

said first layer having gas absorbent pellets therein with a higher density of said pellets in said lower portion than in said upper portion; and said second layer having an integral skin crust on said lower side.

10. The protective mask of claim 9, wherein said pellets comprise a catalyst for oxidizing carbon monoxide to carbon dioxide.

11. The protective mask of claim 10, wherein said pellets comprise $MnO_2$ and CuO.

12. The protective mask of claim 9, wherein said mask body is made of non-woven fabric and has pleats therein.

13. The protective mask of claim 12, wherein said mask body comprises:

ear laces for engaging around the ears of a user; and an elongate aluminum strip extending part way along said mask body between said ear laces and adjacent a top edge of said mask body.

* * * * *